United States Patent [19]

Miyazako et al.

[11] 4,232,111

[45] Nov. 4, 1980

[54] PHOTOGRAPHIC PHOTOSENSITIVE ELEMENT WITH PROTECTIVE LAYER AND IMAGE FORMING METHOD USING SAME

[75] Inventors: Takushi Miyazako; Shigeru Nagatomo, both of Minami-ashigara, Japan

[73] Assignee: Fuji Photo Film Co., Ltd., Minami-ashigara, Japan

[21] Appl. No.: 840,950

[22] Filed: Oct. 11, 1977

Related U.S. Application Data

[63] Continuation of Ser. No. 686,984, May 17, 1976, abandoned, which is a continuation of Ser. No. 506,812, Sep. 17, 1974, abandoned.

[30] Foreign Application Priority Data

Sep. 17, 1973 [JP] Japan ..... 48-104761

[51] Int. Cl.[2] ..... G03C 5/24; G03C 1/78; G03C 1/96

[52] U.S. Cl. ..... 430/355; 430/434; 430/537; 430/961

[58] Field of Search ..... 96/67, 87 A, 87 R, 48 HD, 96/114.1, 50 PL; 430/355, 434, 537, 961

[56] References Cited

U.S. PATENT DOCUMENTS

| | | | |
|---|---|---|---|
| 3,443,946 | 5/1969 | Grabhofer et al. | 96/87 R |
| 3,591,379 | 7/1971 | Plakunou et al. | 96/67 |
| 3,895,949 | 7/1975 | Akamatsu et al. | 96/67 |

*Primary Examiner*—Jack P. Brammer

*Attorney, Agent, or Firm*—Sughrue, Rothwell, Mion, Zinn and Macpeak

[57] ABSTRACT

A photographic photosensitive element containing copolymers comprising (a) 30 to 70 mole % of the recurring unit represented by the formula (I)

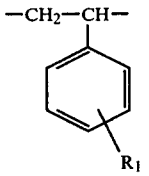

(I)

wherein $R_1$ is a hydrogen atom or a methyl group; and (b) 70 to 30 mole % of the recurring unit represented by the formula (II)

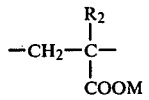

(II)

wherein $R_2$ is a hydrogen atom or a methyl group and M is selected from the group consisting of hydrogen, lithium, sodium, potassium and $NH_4$; in the most upper layer of the element, suitable for processing at temperatures of at least about 27° C. to form an image.

11 Claims, No Drawings

PHOTOGRAPHIC PHOTOSENSITIVE ELEMENT WITH PROTECTIVE LAYER AND IMAGE FORMING METHOD USING SAME

This application is a continuation application of Ser. No. 686,984, filed May 17, 1976, now abandoned, in turn a continuation application of Ser. No. 506,812, filed Sept. 17, 1974, now abandoned.

BACKGROUND OF THE INVENTION

1. Field of the Invention

The present invention relates to a photographic photosensitive element and a method for forming an image using the same. More particularly, it relates to a photographic photosensitive element capable of being rapidly processed at high temperatures of at least 27° C. without the formation of reticulation and to a method for forming images using the same.

2. Description of the Prior Art

In producing a photographic photosensitive element, a silver halide emulsion layer and other layers are coated on a support. To increase the coating rate, the coating temperature should be increased so that the coated photographic materials can be dried rapidly. At high temperature, however, where a known gelatin containing layer is provided as a protective layer, reticulation tends to be formed. Since the formation of reticulation is quite disadvantageous, a high-speed coating has been impossible even though high-speed coating is desirable in producing a photographic film and a printing paper.

An exposed black and white or color film or printing paper is generally processed at temperatures lower than 27° C. High temperature processing increases the reaction rate of development of the silver halide, fixing, and color development, etc., and reduces the processing time. High temperature processing particularly reduces the cost of automatic developing processing. For these reasons, rapid processing of exposed photographic photosensitive elements has been desired for a long time. However, conventional films and printing papers having a protective layer comprising gelatin are damaged by high temperature processing solutions and this has been an obstacle to use of rapid processing of photographic photosensitive elements. For instance, conventional gelatin containing layers when processed at 49.5° C. swell excessively and thus, reticulation is formed in the film.

As a countermeasure for this, a method in which a hardening agent is added to a processing solution can be employed. This method, however, has the defects that the process is complicated and very expensive, and furthermore, the photographic characteristics, particularly that of a color photographic material, are often adversely affected. Thus, inhibiting the formation of reticulation is necessary in producing a photographic photosensitive element, particularly of a multi-layer color element, using a high temperature and high-speed coating method and in applying a high temperature processing at temperatures of not less than about 27° C. and the method employed to achieve the inhibition should not adversely affect the photographic characteristics. Such a method has been sought for a long time.

It has now been found that the formation of reticulation in processing conventional photographic films and printing papers at high temperatures is mainly due to the uppermost layer, e.g., a protective layer. As a result of further investigation, it has been found that the formation of reticulation can be controlled by adding copolymers as described hereinafter to the uppermost layer. Thus, the present invention is based on the above described discovery.

SUMMARY OF THE INVENTION

Accordingly, an object of the present invention is to provide a photographic photosensitive element which can be produced and processed at high temperatures of at least about 27° C. without damage.

Another object of the present invention is to provide a method for forming an image by processing at a temperature of at least about 27° C. using the photographic photosensitive element.

A further object of the present invention is to provide a rapid processing method using the photographic photosensitive element.

These and other objects can be attained with a photosensitive element having an uppermost layer containing copolymers comprising (a) 30 to 70 mole % of the recurring unit represented by the formula (I)

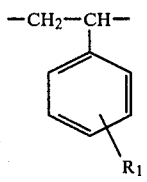

(I)

wherein $R_1$ is a hydrogen atom or a methyl group; and (b) 70 to 30 mole % of the recurring unit represented by the formula (II)

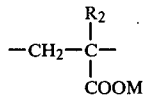

(II)

wherein $R_2$ is a hydrogen atom or a methyl group and M is selected from the group consisting of H, Li, Na, K and $NH_4$.

This invention comprises a photographic photosensitive element containing in the uppermost layer thereof a copolymer comprising (a) 30 to 70 mole % of the recurring unit represented by the formula (I)

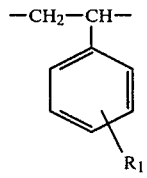

(I)

wherein $R_1$ is a hydrogen atom or a methyl group; and (b) 70 to 30 mole % of the recurring unit represented by the formula (II)

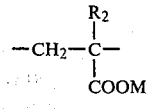

(II)

wherein $R_2$ is a hydrogen atom or a methyl group and M is selected from the group consisting of hydrogen, lithium, sodium, potassium, and $NH_4$.

DETAILED DESCRIPTION OF THE INVENTION

The copolymers as used in the present invention can be easily produced by conventional methods. For instance, styrene and acrylic acid are dissolved in a reaction medium, e.g., methanol, ethanol, acetone, benzene, dimethylformamide, dioxane or mixtures thereof. Then, a polymerization catalyst, e.g., azobisisobutyronitrile, benzoyl peroxide, or the like, is added in an amount of about 0.5 to 2.0% by weight of the monomer used followed by stirring at 60° to 80° C. for 3 to 6 hours under a nitrogen atmosphere. The reaction product is reprecipitated in water, dried, and, if desired, neutralized with sodium hydroxide or the like. A chain transfer agent, e.g., p-cymene, isopropanol, carbon tetrachloride or the like can be effectively used to control the molecular weight of the polymer.

Representative copolymers can be produced by copolymerizing styrene and acrylic acid, styrene and methacrylic acid, methylstyrene and acrylic acid, methylstyrene and methacrylic acid, or a like combination, and, if desired, neutralizing the resulting polymers.

In the copolymers of the present invention, a high content of the styrene or methylstyrene unit reduces the compatibility of the copolymer with gelatin whereas a high content of the acrylic acid or methacrylic acid unit adversely affects the sensitivity. Thus, the styrene or methylstyrene content is about 30 to 70 mole % and preferably 40 to 60 mole %. The acrylic acid or methacrylic acid content is about 70 to 30 mole % and preferably 60 to 40 mole %. Too low a molecular weight reduces the effect of the copolymer while too high a molecular weight reduces the compatibility of the copolymer with gelatin. Thus, the reduced viscosity, i.e., $\eta$ sp/c as measured in a 1% by weight sodium chloride aqueous solution at 30° C., is about 0.2 to 2.0 and preferably 0.3 to 1.0.

The photographic light-sensitive element which can be used in the present invention is characterized as having an uppermost layer which contains the copolymer described hereinbefore.

The uppermost layer comprises a hydrophilic colloid and the copolymer of the present invention. The hydrophilic colloid which is preferably used in the present invention is gelatin. Also, a part of the gelatin, generally up to about 70% by weight of the gelatin used can be replaced by one or more hydrophilic colloids other than gelatin. Any hydrophilic colloid which is conventionally used in a hydrophilic layer of a photographic material can be used and examples include colloidal albumin, casein, cellulose derivatives such as carboxymethyl cellulose, hydroxyethyl cellulose and the like, agar, sodium alginate, saccharide derivatives such as starch derivatives, synthetic hydrophilic colloids, e.g., polyvinyl alcohol, polyvinyl pyrrolidone, acrylic acid copolymers, polyacrylamide, and derivatives thereof, gelatin derivatives such as gelatin treated with a compound having at least one group capable of reacting with the functional groups contained in gelatin, i.e., an amine group, an imino group, a hydroxy group, and a carboxy group, or those gelatins to which high polymeric molecular chains have been grafted, and the like.

Compounds which can be used for preparing gelatin derivatives are, e.g., isocyanates, acid chlorides and acid anhydrides as described in U.S. Pat. No. 2,614,928; acid anhydrides as described in U.S. Pat. No. 3,118,766; bromo acetates as described in Japanese Patent Publication No. 5514/1964; phenyl glycidyl ethers as described in Japanese Patent No. 26845/1967; vinyl sulfone compounds as described in U.S. Pat. No. 3,132,945; N-allylvinyl sulfonamides as described in British Pat. No. 861,414; maleinimide compounds as described in U.S. Pat. No. 3,186,846; acrylonitriles as described in U.S. Pat. No. 2,594,293; polyalkylene oxides as described in U.S. Pat. No. 3,312,553; epoxy compounds as described in Japanese Patent Publication No. 26845/1967; acid esters as described in U.S. Pat. No. 2,763,639; alkanesultones as described in British Pat. No. 1,033,189; etc.

Suitable branch polymers to be grafted to gelatin include polymers or copolymers of the so-called vinyl monomers such as acrylic acid, methacrylic acid, or the esters, amides, or nitriles thereof, or styrene as described in U.S. Pat. Nos. 2,763,625; 2,831,767; 2,956,884; 3,620,751; *Polymer Letters,* 5, 595 (1967), *Phot. Sci. Eng.,* 9, 148 (1965), *J. Polymer Sci.,* A-1, 9, 199 (1971), etc. Hydrophilic vinyl polymers which are mutually compatible with gelatin to a certain extent, such as polymers or copolymers of acrylic acid, methacrylic acid, acrylamide, methacrylamide, hydroxyalkylacrylate, hydroxyalkylmethacrylate, etc., are particularly useful.

The amount of the copolymer of the present invention which is incorporated in the uppermost layer can be varied over wide range, since the copolymer is compatible with gelatin in any ratio. A suitable amount ranges from about 10 to about 70, and particularly from 20 to 50, % by weight.

Advantageously the binder of the uppermost layer is hardened using a hardening agent.

A matting agent, e.g., particles of polystyrene, polymethyl methacrylate, silica or the like, which is generally used in the field of photography, can be, if desired, added, e.g., in an amount of from about 0.1 to about 5, preferably 0.3 to 2, % by weight based on the total amount of the hydrophilic colloid in the layer, to the layer comprising the copolymer and a binder. A suitable particle size ranges from about 0.1 to about 5 microns, preferably 0.3 to 3 microns. Moreover, where the copolymer is used in combination with a binder such as gelatin or its derivatives, a hardening agent can be advantageously used.

Suitable hardening agents which can be preferably used include those hardening agents as described in C. E. K. Mees and T. H. James, *The Theory of the Photographic Process,* 3rd. Edition, pages 55–60, Macmillan Co. (1966), and U.S. Pat. No. 3,316,095. Particularly, aldehyde type (including mucochloric acid type and aldehyde precursor type hardening agents), e.g., as disclosed in U.S. Pat. Nos. 3,232,761; 3,565,632; 3,677,760, active vinyl type, e.g., as disclosed in U.S. Pat. Nos. 3,635,718; 3,232,763; etc., active halogen type, e.g., as disclosed in U.S. Pat. Nos. 3,288,775; 3,732,303; etc., carbodiimide type, e.g., as disclosed in U.S. Pat. Nos. 3,100,704; etc., isooxazole type, e.g., as disclosed in U.S. Pat. Nos. 3,321,313; 3,543,292; etc., epoxy type, e.g., as disclosed in U.S. Pat. No. 3,091,537; etc., aziridine type, e.g., as disclosed in U.S. Pat. Nos. 3,017,280; 2,983,611; etc., and inorganic type hardening agents can be preferably used. A suitable amount of the hardening agent can range from about 0.1 to about 10, preferably 0.3 to 5, % by weight based on the total amount of the hydrophilic colloid in the layer. More particularly, the following hardening agents provide good results. Aldehyde type hardening agents:

Mucochloric acid, mucobromic acid, mucophenoxychloric acid, mucophenoxybromic acid, formaldehyde, dimethylolurea, trimethylolmelamine, 1,3-bis-(diallylamino)methyl urea, 1,3-bis(piperidinomethyl)urea, glyoxal, monomethylglyoxal, 2,3-dihydroxy-1,4-dioxane, 2,3-dihydroxy-5-methyl-1,4-dioxane, succinaldehyde, 2,5-dimethoxytetrahydrofuran, glutaraldehyde, etc.

Active vinyl type hardening agents:

1,3,5-Triacryloyl-hexahydro-s-triazine, 1,3,5-trivinylsulfonylhexahydro-s-triazine, etc.

Active halogen type hardening agents:

2,4-Dichloro-6-(4'-sulfoanilino)-1,3,5-triazine-sodium salt, 2,4-dichloro-6-hydroxy-1,3,5-triazine-sodium salt, 2,4-dichloro-6-(2'-sulfoethylamino)-1,3,5-triazine-sodium salt, etc.

Carbodiimide type hardening agents:

Dichlorohexylcarbodiimide, 1-cyclohexyl-3-(3-trimethylaminopropyl)carbodiimide-p-toluenesulfonate, 1-ethyl-3-(3-dimethylaminopropyl)carbodiimide hydrogen chloride, etc.

Isooxazole type hardening agents:

2,5-Dimethylisooxazole perchlorate, 2-ethyl-5-phenylisooxazole-3'-sulfonate, 5,5'-(p-phenylene)-bisisooxazole, etc.

Epoxy type hardening agents:

1,4-bis(2',3'-Epoxypropoxy)butane, 1,3,5-triglycidylisocyanurate, etc.

Aziridine type hardening agents:

1,6-Hexamethylene-N,N'-bis-ethylene urea, 2,4,6-triethyleneimino-1,3,5-triazine, etc.

Inorganic hardening agents:

Chromium alum, chromium acetate, etc.

These hardening agents can be, as in conventional methods, dissolved in water or an organic solvent and directly added to the uppermost layer containing the copolymers or can be added to other layers in a large amount so that the hardening agent diffuses into the uppermost layer. Of these hardening agents, dichlorohydroxy-s-triazine sodium salt, triethyleneimino-s-triazine, formaldehyde, glyoxal, mucochloric acid, trichlorotriazine, 3-chloro-1,2-propyleneglycol-diglycidyl ether and the like are particularly preferred.

In addition, as a coating aid, sodium dodecyl benzene sulfonate, sodium N-oleyl-N-methyl-taurate, sodium 1,4-p-nonylphenyl-5,8,11,14-tetraoxatetradecane-1-sulfonate, dimethyltetradecyl ammonioacetate, and the like can be used. The mixing ratio of the copolymer of the present invention, gelatin, a matting agent (e.g., fine particles of inorganic or organic compound such as silica, magnesium oxide, polymethyl methacrylate, cellulose acetate propionate, etc.), an anti-adhesive agent, an anti-slip agent (e.g., polyethyleneoxide, glycerol, etc.), a lubricant (e.g., polydimethylsiloxane, stearylamide, etc.), an antistatic agent (e.g., saponin, polyoxyethylene lauryl ether, etc.), a hardening agent, and a coating aid, etc., can be varied over a wide range depending upon the kind and use of the photographic photosensitive element. The type and suitable amounts of the above described ingredients can be determined by one skilled in the art.

Appropriate selection of a suitable coating method is important for increasing productivity. For instance, dip coating, air knife coating, curtain coating, extrusion coating, etc., can be used. An uppermost layer containing the copolymer of this invention can suitably range in thickness from about 0.5 to about 3, preferably 1 to 1.5, microns.

The copolymer which can be used in the present invention cn also be added to other photographic hydrophilic layers of the photographic material. Such photographic layers include a silver halide emulsion layer, an intermediate layer, a filter layer, and the like.

The present invention is further illustrated in greater detail by reference to the following examples. Unless otherwise indicated, all parts, percents, ratios and the like are by weight.

PREPARATION EXAMPLE 1

A reaction vessel was charged with 43 g (0.5 mole) of methacrylic acid, 52 g (0.5 mole) of styrene, 150 ml of ethanol and 0.45 g of benzoyl peroxide as a polymerization initiator. After purging the system with nitrogen, the mixture was stirred at 70° to 80° C. for 5 hours. Then, the reaction product was reprecipitated in water and vacuum-dried until a constant weight was reached. Thus, Copolymer-1 was obtained. The yield was 69.3 g (73.0%). The product was neutralized with sodium hydroxide to adjust the pH of a 20% aqueous solution to 7.5. The viscosity was 0.73 ($\eta$ sp/c.c=0.1%, 30° C.).

The same procedure was repeated to produce Copolymer-2 and Copolymer-3 using the monomers and proportions as indicated in the following table.

| Copolymer | Monomer | Amount Charged (g) | Yield | $\eta$ sp/c.c | pH |
|---|---|---|---|---|---|
| Copolymer-1 | Methacrylic Acid | 43 | 69.3 g | 0.73 | 7.5 |
| | Styrene | 52 | (73.0%) | | |
| Copolymer-2 | Acrylic Acid | 36 | 61.4 g | 0.27 | 7.8 |
| | Styrene | 52 | (76.7%) | | |
| Copolymer-3 | Acrylic Acid | 25.2 | 80.1 g | 0.31 | 7.8 |
| | Vinyl Toluene | 76.7 | (78.6%) | | |

EXAMPLE 1

On an undercoated cellulose triacetate base were coated a red-sensitive silver halide emulsion layer, an intermediate layer, a green-sensitive silver halide emulsion layer, a yellow filter layer, a blue-sensitive silver halide emulsion layer, and a protective layer as indicated in Table 1 below. Mixtures of gelatin as a binder and Copolymer-1 containing 0, 20, 40, 60 and 80% by weight of Copolymer-1 were used for the protective layer to produce Samples 1, 2, 3, 4, and 5, respectively. To each of these binder combinations, 2,4,6-triethyleneimino-1,3,5-triazine was added in an amount of 25 mg per gram of the binder as a hardening agent. In addition, as a matting agent, silicon dioxide particles and polymethyl methacrylate particles were added. The thus prepared mixtures were coated and dried to provide a dry thickness of 1 to 2$\mu$.

With these samples, no reticulation was observed.

TABLE 1

| | Red-Sensitive Layer | Green-Sensitive Layer | Blue-Sensitive Layer |
|---|---|---|---|
| Color Coupler | 4-Chloro-N-n-dodecyl-1-hydroxy-2- | 1-2,4,6-Trichlorophenyl-3-{3-($\alpha$-2,4-di-t-amylphenoxy)- | 3-(2,4-Di-amylphenoxyacetamido)-$\alpha$-(4-methoxybenzoyl)acetanilide |

TABLE 1-continued

| | Red-Sensitive Layer | Green-Sensitive Layer | Blue-Sensitive Layer |
|---|---|---|---|
| | naphthamide | acetamido}-benzamido-5-pyrazolone | |
| Spectral Sensitizer | bis-(9-Ethyl-5-chloro-3-hydroxyethyl)-thiacarbocyanine bromide | bis-(9-Ethyl-5-phenyl-3-ethyl)-oxycarbocyanine isothiocyanate | None |
| Stabilizer | 5-Methyl-7-hydroxy-2,3,4-triazaindolizine | Same as used in red-sensitive layer | Same as used in red-sensitive layer |
| Hardening Agent | 2,4,6-Triethyleneimino-1,3,5-triazine | Same as used in red-sensitive layer | Same as used in red-sensitive layer |
| Auxiliary Coating Agent | Sodium dodecylbenzene sulfonate | Same as used in red-sensitive layer | Same as used in red-sensitive layer |

Intermediate Layer: A gelatin layer containing the hardening agent and auxiliary agent as indicated in Table 1.
Yellow Filter Layer: A gelatin layer containing the hardening agent, auxiliary agent as indicated in Table 1 and yellow colloidal silver.

These samples were allowed to stand under the conditions of a temperature of 25° C. and 60% RH for 1 week. After subjecting these samples to color negative processing, these samples were examined with respect to the formation of reticulation. The processing temperature was 35°, 40°, 45° or 50° C.

| | Time |
|---|---|
| Color Development | 3' 15" |
| Bleaching | 6' 30" |
| Washing | 3' 15" |
| Fixing | 6' 30" |
| Washing | 3' 15" |
| Stabilizing Bath | 3' 15" |

With each of the samples processed, the degree of the formation of reticulation was as illustrated in Table 2.

TABLE 2

| Processing Temperature (°C.) | Sample 1 | 2 | 3 | 4 | 5 |
|---|---|---|---|---|---|
| 35 | C | A | A | A | A |
| 40 | C | B | A | A | A |
| 45 | C | C | B | A | A |
| 50 | C | C | C | B | B |

A: No reticulation was observed.
B: Slight reticulation was observed.
C: Considerable reticulation was observed.

It can be seen from the results in Table 2 that the formation of reticulation is prevented by replacing a part of the gelatin with Copolymer-1 of the present invention and that the formation of reticulation is more prevented by increasing the content of Copolymer-1.

EXAMPLE 2

To each of the layers as used in Example 1 was added Copolymer-2 in the following manner.

Sample 1: No layer contained Copolymer-2.

Sample 2: 30% of the gelatin contained in the intermediate layer and the yellow filter layer was replaced with Copolymer-2.

Sample 3: 30% of the gelatin contained in all of the layers except for the protective layer was replaced with Copolymer-2.

Sample 4: 30% of only the gelatin contained in the protective layer was replaced with Copolymer-2.

Sample 5: 30% of the gelatin contained in each of the intermediate layer, the yellow filter layer and the protective layer was replaced with Copolymer-2.

Sample 6: 30% of the gelatin contained in all of the layers was replaced with Copolymer-2.

These samples were allowed to stand under the conditions of a temperature of 25° C. and 60% RH for 1 week and, after being subjected to the same processing as described in Example 1, were examined with respect to the formation of reticulation. The results obtained are shown in Table 3.

TABLE 3

| Processing Temperature (°C.) | Sample 1 | 2 | 3 | 4 | 5 | 6 |
|---|---|---|---|---|---|---|
| 35 | C | B | A | A | A | A |
| 40 | C | C | C | A | A | A |
| 45 | C | C | C | B | A | A |
| 50 | C | C | C | C | C | A |

A, B and C designate the same grades as set forth for Example 1.

It can be seen from Table 3 that the formation of reticulation is most effectively prevented by replacing a part of the gelatin contained in all of the layers with Copolymer-2 and that a considerable effect can be attained by replacing only a part of the gelatin contained in the protective layer.

EXAMPLE 3

On an undercoated polyethylene terephthalate base were coated a red-sensitive silver halide emulsion layer, a green-sensitive silver halide emulsion layer, a yellow filter layer and a blue-sensitive silver halide emulsion layer, which contained the same spectral sensitizer, stabilizer, and auxiliary coating agent as described in Example 1, and 5 mg of 2-oxy-4,6-dichloro-s-triazine sodium salt per gram of the binder as a hardening agent, in the following manner.

Sample 1: No layer contained Copolymer-3.

Sample 2: 20% of the gelatin contained in the red-sensitive emulsion layer, the green-sensitive emulsion layer and the yellow filter layer was replaced with Copolymer-3.

Sample 3: 20% of the gelatin contained in the blue-sensitive emulsion layer only was replaced with Copolymer-3.

Sample 4: 20% of the gelatin contained in all four layers was replaced with Copolymer-3.

These samples were allowed to stand at a temperature of 25° C. and 0.60% RH for week and, after being subjected to the following color-in-developer type color processing (the pre-hardening time was changed from 10 seconds to 50 seconds), examined with respect to the formation of reticulation.

| | | Temperature | Time |
|---|---|---|---|
| 1. | Pre-hardening | 27° C. | as indicated in Table 4 |
| 2. | Washing | " | 1 minute |
| 3. | Negative Development | " | 4 minutes |
| 4. | Washing | " | 3 minutes |
| 5. | Reversal Red Flash Exposure | | |
| 6. | Cyan Color Development | " | 5 minutes |
| 7. | Washing | " | 2 minutes |
| 8. | Reversal Blue Flash Exposure | | |
| 9. | Yellow Color Development | " | 5 minutes |
| 10. | Washing | " | 2 minutes |
| 11. | Reversal White Exposure | | |
| 12. | Magenta Color Development | 27° C. | 5 minutes |
| 13. | Washing | " | 2 minutes |
| 14. | Silver Bleaching | " | 5 minutes |
| 15. | Fixing | " | 3 minutes |
| 16. | Washing and Drying | | |

Each of the compositions of processing baths are shown in columns 18 and 19 of U.S. Pat. No. 3,723,125. The degree of the formation of reticulation is indicated in Table 4.

TABLE 4

| Pre-Hardening Time (seconds) | Sample 1 | 2 | 3 | 4 |
|---|---|---|---|---|
| 10 | C | C | C | B |
| 20 | C | B | B | A |
| 30 | C | B | A | A |
| 40 | B | A | A | A |
| 50 | A | A | A | A |

A, B and C designate the same grades used for Example 1.

It can be seen from the results in Table 4 that the formation of reticulation is reduced by replacing a part of the gelatin with Copolymer-3.

While the invention has been described in detail and with reference to specific embodiments thereof, it will be apparent to one skilled in the art that various changes and modifications can be made therein without departing from the spirit and scope thereof.

What is claimed is:

1. A photographic photosensitive element containing at least one silver halide emulsion layer and as the uppermost layer thereof a protective layer containing about 10 to about 70% by weight of a copolymer consisting of (a) 30 to 70 mole % of the recurring unit represented by the formula (I)

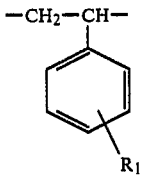

(I)

wherein $R_1$ is a hydrogen atom or a methyl group; and (b) 70 to 30 mole % of the recurring unit represented by the formula (II)

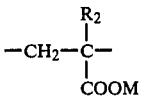

(II)

wherein $R_2$ is a hydrogen atom or a methyl group and M is selected from the group consisting of hydrogen, lithium, sodium, potassium and $NH_4$.

2. The photographic photosensitive element according to claim 1, wherein the uppermost layer further contains a hydrophilic colloid.

3. The photographic photosensitive element according to claim 2, wherein the hydrophilic colloid is selected from the group consisting of gelatin, colloidal albumin, casein, a cellulose derivative, sodium alginate, a saccharide derivative, agar, a gelatin derivative, polyvinyl alcohol, an acrylic acid polymer or copolymer, polyacrylamide and polyvinyl pyrrolidone.

4. The photographic photosensitive element according to claim 1, wherein the uppermost layer further contains a hardening agent for the hydrophilic colloid.

5. A method for forming an image wherein reticulation is eliminated or minimized which comprises development processing an exposed photographic photosensitive element of claim 1 at 27° C. or higher.

6. The photographic photosensitive element of claim 1 wherein said copolymer consists of 40 to 60 mole % of the unit of the formula I and 60 to 40 mole % of the unit of the formula II.

7. The photographic photosensitive element of claim 1 wherein said copolymer has a reduced viscosity as measured in a 1% by weight sodium chloride aqueous solution at 30° C. of about 0.2 to 2.0.

8. The photographic photosensitive element of claim 7 wherein said reduced viscosity is about 0.3 to 1.0.

9. The photographic photosensitive element of claim 1 wherein said copolymer consists of styrene and acrylic acid.

10. The photographic photosensitive element of claim 1 wherein said copolymer consists of styrene and methacrylic acid.

11. The photographic photosensitive element of claim 1 wherein said copolymer consists of vinyl toluene and acrylic acid.

* * * * *